US008211217B2

(12) United States Patent
Tsai et al.

(10) Patent No.: US 8,211,217 B2
(45) Date of Patent: Jul. 3, 2012

(54) WET ELECTROSTATIC PRECIPITATOR WITH PULSE JET FOR CLEANING DISCHARGE WIRES

(75) Inventors: Chuen-Jinn Tsai, Hsinchu County (TW); Guan-Yu Lin, Taipei County (TW)

(73) Assignee: National Chiao Tung University, Hsinchu (TW)

( * ) Notice: Subject to any disclaimer, the term of this patent is extended or adjusted under 35 U.S.C. 154(b) by 459 days.

(21) Appl. No.: 12/654,326

(22) Filed: Dec. 17, 2009

(65) Prior Publication Data

US 2011/0056375 A1 Mar. 10, 2011

(30) Foreign Application Priority Data

Sep. 10, 2009 (TW) ..... 98130621 A

(51) Int. Cl.
*B03C 3/53* (2006.01)
*B03C 3/78* (2006.01)

(52) U.S. Cl. ..... 96/45; 96/47; 96/48; 96/50; 96/65; 96/69; 96/96; 96/98

(58) Field of Classification Search ..... 96/43–50, 96/52, 64–66, 69, 96, 98; 95/59, 75, 78; 261/112.1, 112.2
See application file for complete search history.

(56) References Cited

U.S. PATENT DOCUMENTS 3,238,702 A * 3/1966 DeSeversky ..... 96/45
3,765,154 A * 10/1973 Hardt et al. ..... 96/88
3,785,125 A * 1/1974 DeSeversky ..... 96/45
4,388,089 A * 6/1983 Reif et al. ..... 96/45
4,529,418 A * 7/1985 Reif et al. ..... 96/45
4,597,780 A * 7/1986 Reif ..... 96/45
5,137,546 A * 8/1992 Steinbacher et al. ..... 95/71
5,395,430 A 3/1995 Lundgren et al.
5,626,652 A * 5/1997 Kohl et al. ..... 96/45
6,106,592 A * 8/2000 Paranjpe et al. ..... 95/65

(Continued)

FOREIGN PATENT DOCUMENTS

JP 52-59374 A * 5/1977 ..... 96/45

OTHER PUBLICATIONS

Hyun Ha Kim, Isao Yamamoto, Kazunori Takashima, Shinji Katsura and Akira Mizuno, Incinerator Flue Gas Cleaning Using Wet-Type Electrostatic Precipitator, Journal of Chemical Engineering of Japan, (2000)669-674.

(Continued)

*Primary Examiner* — Richard L Chiesa
(74) *Attorney, Agent, or Firm* — Bacon & Thomas, PLLC

(57) ABSTRACT

A wet electrostatic precipitator (ESP) is disclosed to have a housing, several discharge wires, two roughened collection electrodes coated with $TiO_2$ or $SiO_2$ nanoparticles, two porous metallic plates, and two roughened glass plates coated with $TiO_2$ or $SiO_2$ nanoparticles. The porous metallic plates and the glass plates coated with $TiO_2$ or $SiO_2$ nanoparticles located above the collection electrodes are used to enhance the uniformity of the water film. When particles are introduced into the ESP, they are charged by gas ions generated by corona discharge, and then migrate to collection electrodes due to electrostatic force. Finally, particles are removed by uniform water film flowing downward along the collection electrodes. Furthermore, pulse jet passing through the small holes on the collection plates is used to clean discharge wires, maintaining electric corona strength and prolonging the operation life.

6 Claims, 2 Drawing Sheets

U.S. PATENT DOCUMENTS

| | | | | |
|---|---|---|---|---|
| 6,231,643 | B1 | 5/2001 | Pasic et al. | |
| 6,783,575 | B2 * | 8/2004 | Pasic et al. | 96/44 |
| 7,833,324 | B2 * | 11/2010 | Chen et al. | 96/45 |
| 2008/0216659 | A1 * | 9/2008 | Maekawa et al. | 96/44 |

OTHER PUBLICATIONS

Innovative Wet Electrostatic Precipitator Technology, Filtration & Separation, Jun. 1998, p. 433-435.

Phirun Saiyasitpanich, Tim C. Keener, Soon-Jai Khang, Mingming Lu, Removal of Diesel Particulate Matter (DPM) in A Tubular Wet Electorstatic Precipitator, Journal of Electrostatics 65 (2007) , 618-624.

David J. Bayless, M. Khairul Alam, Roger Radcliff, John Caine, Membrane-based Wet Electrostatic Precipitation, Fuel Processing Technology 85 (2004) 781-798.

H. Pasic, J. Caine, H. Shah, MWESP: Membrane Tubular Wet Electrostastic Precipitators, Filtration & Separation, Nov. 2006, p. 16-18.

* cited by examiner

WET ELECTROSTATIC PRECIPITATOR WITH PULSE JET FOR CLEANING DISCHARGE WIRES

BACKGROUND OF THE INVENTION

1. Field of the Invention

The present invention relates generally to air pollution control equipment, and more particularly to a wet electrostatic precipitator (wet ESP) which makes use of wetted nanoparticles-coated dispersion plates to keep the collection surfaces clean and pulse jet for keeping the discharge wires clean.

2. Description of the Related Art

General Electrostatic precipitators (ESPs), having dry and wet types, have been widely used to remove particles emitted from various industrial processes. When particles are introduced into the ESPs, they are charged by diffusion and field charging mechanism and are collected on the collection electrodes by electrostatic force.

The wet ESPs have been developed to control a wider variety of particulate pollutants and exhaust gas conditions compared to the dry ESPs, especially for the dust which is sticky, corrosive or has high resistivity. The periodic or continuous scrubbing water flow used to wash the collection electrode surfaces was found to increase the collection efficiency and prevent particle re-entrainment due to rapping, which occurs in dry ESPs.

The U.S. Pat. No. 5,395,430 disclosed a wire-in-tube wet ESP in which the scrubbing water was introduced onto a diamond-shaped plate, which was used to equalize the water flow, and then flowed into the inner surface of the collection electrode to remove the collected particles. However, high flow rate of scrubbing water was used to generate uniform water film on the internal wall of the collection tubes which resulted in a thick water film, thus decreasing the electric field strength due to water resistivity. Besides, deposition of particles onto the discharge wires forms dust cakes, which decrease the corona intensity and the lifetime of the discharge wires.

SUMMARY OF THE INVENTION

The primary objective of the present invention is to provide a wet ESP in which a flowing uniform liquid film washes and removes particles deposited on the collection electrode surface.

The secondary objective of the present invention is to provide a wet ESP in which a pulse jet valve is used to regularly purge the discharge wires to remove particles deposited on the discharge wire surfaces.

The foregoing objectives of the present invention are attained by the wet ESP composed of a housing, a discharge wire, a collection electrode, and a scrubbing-liquid dispersion member. The housing is hollow inside, including a chamber, a waste gas inlet, a gas outlet, a scrubbing-liquid overflow reservoir, a scrubbing-liquid collection reservoir, and a pulse jet passage. The scrubbing-liquid overflow reservoir and the scrubbing-liquid collection reservoir are located at the top and bottom of the chamber, respectively. The waste gas inlet and the gas outlet are connected to the chamber. The discharge wire is mounted inside the chamber. The collection electrode is mounted inside the housing and locates between the chamber and the pulse jet passage. There are several small holes from which the pulse jet is blown into the chamber from the pulse jet passage for discharge wire cleaning. The scrubbing-liquid dispersion member on an internal sidewall of the housing is composed of a porous metallic plate and a glass plate and located at the bottom of the scrubbing-liquid overflow reservoir and at top of the collection electrode. Besides, the wet ESP further includes a baffle mounted inside the housing and located between the chamber and the scrubbing-liquid collection reservoir.

DETAILED DESCRIPTION OF PREFERRED EMBODIMENTS

Figure 1:
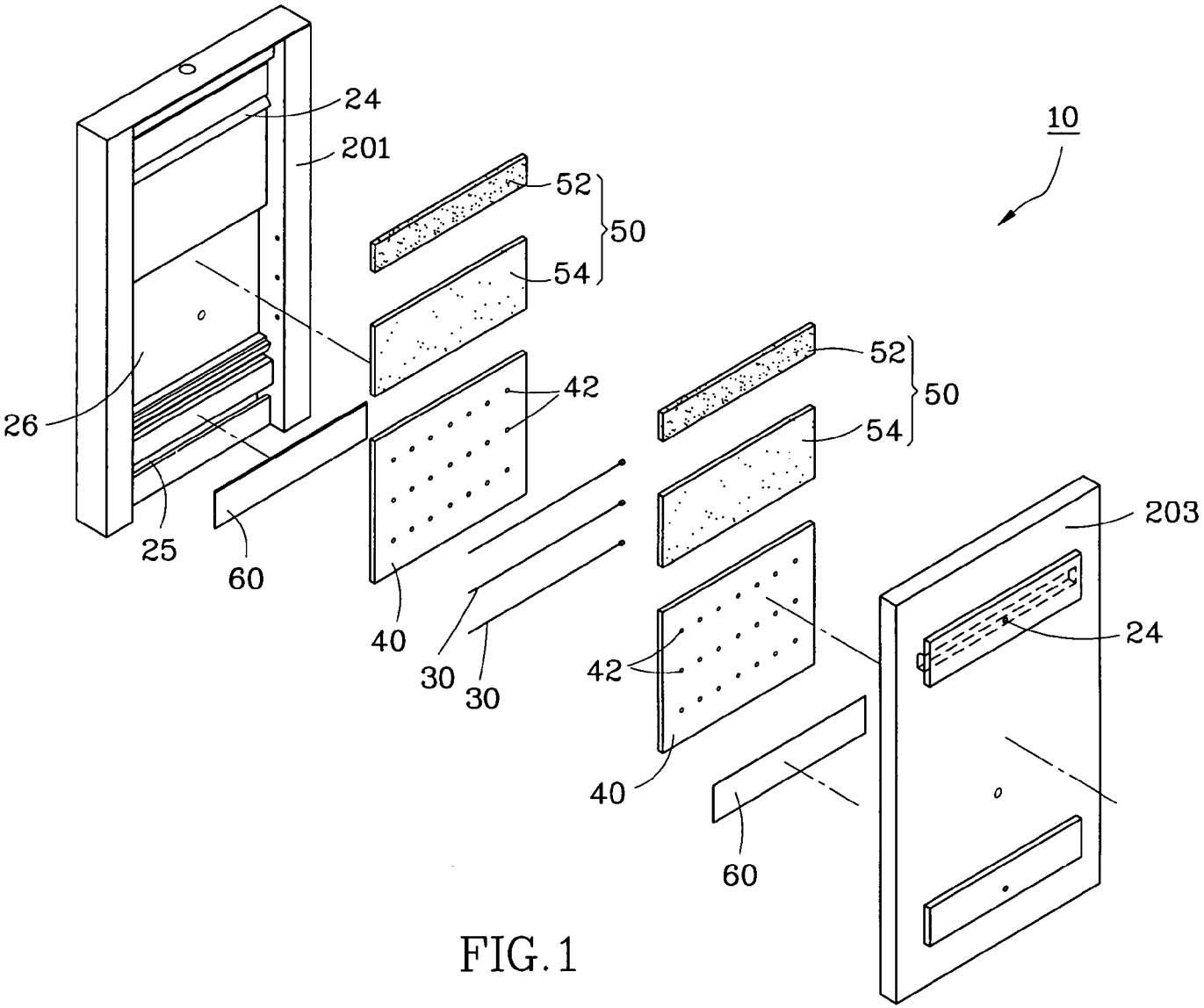
FIG. 1 is an exploded view of a preferred embodiment of the present invention.
Figure 2:
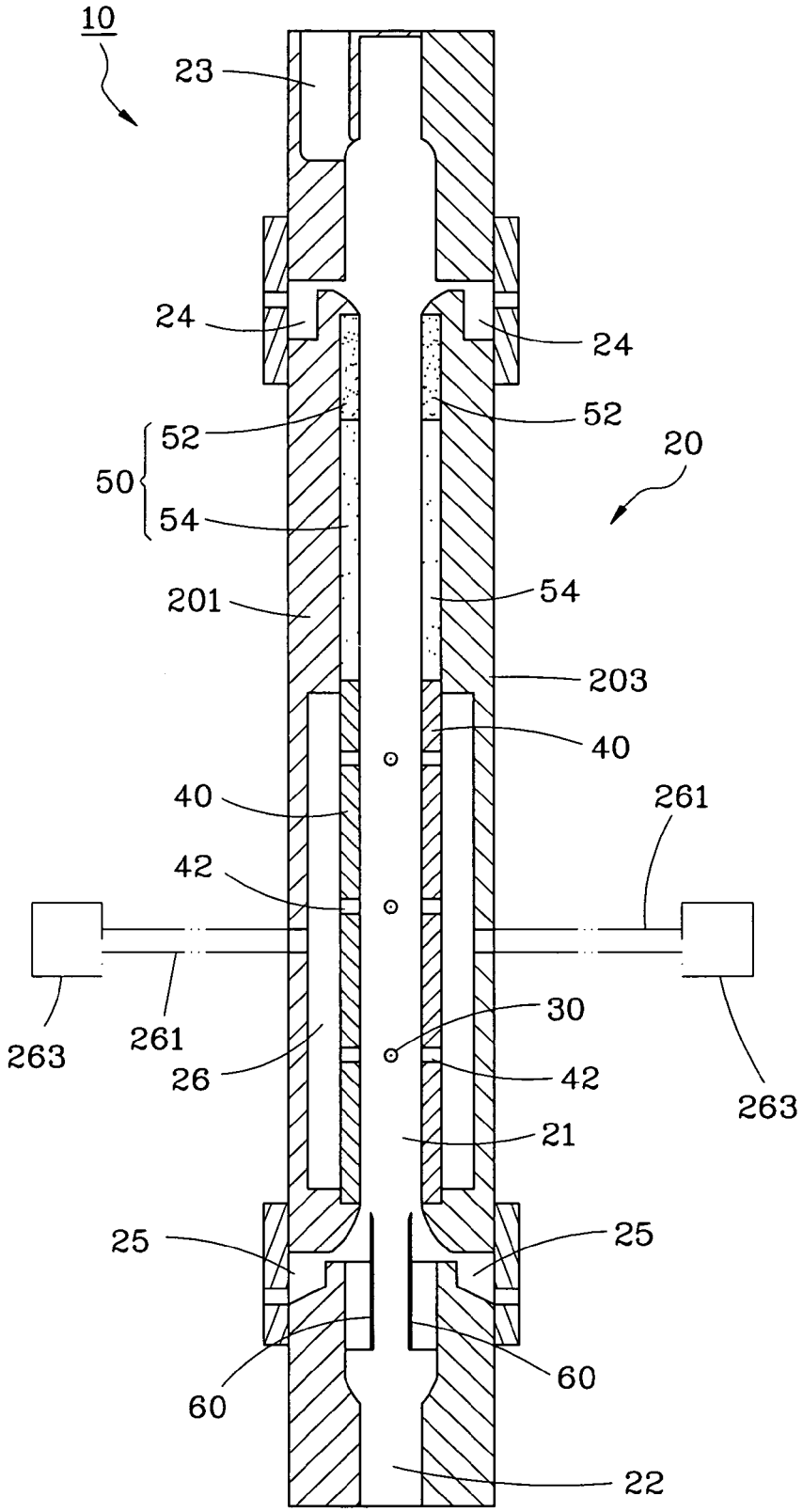
FIG. 2 is a sectional view of the preferred embodiment of the present invention.

Referring to FIGS. 1-2, an ESP 10 with pulse jet for cleaning discharge wires is composed of a housing 20, three discharge wires 30, two collection electrodes 40, two scrubbing-liquid dispersion members 50, and two scrubbing-liquid baffles 60.

The housing 20 is formed from a left side cover 201 and a right side cover 203. Each of the left and right side covers 201 and 203 is made of acrylic or other refractory, acid-resistant, and alkali-resistant material. The housing 20 is hollow inside and includes a chamber 21, a waste gas inlet 22, a gas outlet 23, two scrubbing-liquid overflow reservoirs 24, two scrubbing-liquid collection reservoirs 25, and two pulse jet passages 26. The scrubbing-liquid overflow and collection reservoirs 24 and 25 connect with the chamber 21. The waste gas inlet 22 and the gas outlet 23 run through the housing 20 for communication with the chamber 21 and an outside of the housing 20. The two pulse jet passages 26 are connected with a pulse jet controller (not shown) via a pulse jet pipeline 261 and a pulse jet valve 263.

Each of the discharge wires 30 is made of a metal and mounted inside the chamber 21.

Each of the two collection electrodes 40 is made of a metal plate and mounted inside the housing 20, and located between the chamber 21 and the pulse jet passage 26, including a plurality of holes 42 from which the pulse jet is blown into the chamber 21 from the pulse jet passage 26. The holes 42 are located at a position corresponding to the discharge wires 30. A pulse jet generated from the pulse jet controller passes through the jet passages 26 and the small holes 42 on the collection electrodes 40 to purge the discharge wires 30. The discharge wires 30 are connected with a high-voltage DC power source (not shown), whereas the collection electrodes 40 are grounded, thus electric field can be formed between the discharge wires 30 and the collection electrodes 40.

The two scrubbing-liquid dispersion members 50 are mounted to an internal sidewall of the housing 20 and located at a bottom side of the scrubbing-liquid overflow reservoirs 24 and a top side of the collection electrodes 40. Each of the two scrubbing-liquid dispersion members 50 includes a roughened porous metallic plate 52 and a roughened glass plate 54 coated with $TiO_2$ or $SiO_2$ nanoparticles. Each of the porous metal plates 52 is located above one of the glass plates 54. Each of the glass plates 54 has a roughened surface treated by sand blasting and is coated with $TiO_2$ or $SiO_2$ nanoparticles. Because of the hydrophilicity and porosity of the dispersion member 50, the scrubbing water forms a uniform water film on the dispersion member 50 due to capillary force.

In addition to the glass plates 54, the hydrophilic collection electrodes 40 can be obtained by sand blasting the surface first and then coating the surface with $TiO_2$ or $SiO_2$ nanoparticles.

In this embodiment, the two discharge wires 30 can be oriented perpendicular or parallel to the gas flowing direction of the gas.

Each of the two scrubbing-liquid baffles 60 are mounted inside the housing 20 and located between the chamber 21 and the scrubbing-liquid collection reservoir 25, thus scrubbing liquid passing through the porous metal plates 52, the glass plates 54, and the collection electrodes 40 can be successfully introduced into the scrubbing-liquid collection reservoirs 25.

When waste gas passes through the waste gas inlet 22 into the chamber 21, particles are charged by diffusion and field charging mechanisms and collected by the collection electrodes 40 due to electrostatic force. The scrubbing liquid passes through the scrubbing-liquid overflow reservoirs 24 into the chamber 21 and then flows downward along the porous metallic plates 52, the glass plates 54, and the collection electrodes 40 in sequence, such that the charged particles are flushed out by the scrubbing liquid before adhering onto the collection electrodes 40. The gas exhausts through the gas outlet 23. The scrubbing liquid flowing downward along the collection electrodes 40 exhausts through the scrubbing-liquid collection reservoirs 25 and can then be recycled as the scrubbing-liquid after proper filtration.

Although the present invention has been described with respect to a specific preferred embodiment thereof, it is in no way limited to the specifics of the illustrated structures but changes and modifications may be made within the scope of the appended claims.

What is claimed is:

1. A wet electrostatic precipitator (ESP) comprising:

a hollow housing having a chamber, a waste gas inlet, a gas outlet, a scrubbing-liquid overflow reservoir, a scrubbing-liquid collection reservoir, and a jet passage, the scrubbing-liquid overflow reservoir and the scrubbing-liquid collection reservoir being in communication with the chamber, the waste gas inlet and the gas outlet running through the housing for communication with the chamber and an outside of the housing;

a discharge wire mounted inside the chamber;

a collection electrode mounted inside the housing and located between the chamber and the jet passage, the collection electrode having a plurality of holes communicating with the chamber and the jet passage and in a position corresponding to the discharge wire; and a scrubbing-liquid dispersion member having a roughened surface and disposed on an internal sidewall of the housing, the scrubbing-liquid dispersion member being located at a bottom side of the scrubbing-liquid overflow reservoir and a top side of the collection electrode.

2. The wet ESP as defined in claim 1, wherein the scrubbing-liquid dispersion member comprises a porous metallic plate.

3. The wet ESP as defined in claim 1, wherein the scrubbing-liquid dispersion member comprises a roughened glass plate coated with $TiO_2$ or $SiO_2$ nanoparticles.

4. The wet ESP as defined in claim 1, wherein the scrubbing-liquid dispersion member comprises a hydrophilic surface.

5. The wet ESP as defined in claim 1, wherein the scrubbing-liquid dispersion member comprises a porous metallic plate and a roughened glass plate coated with $TiO_2$ or $SiO_2$ nanoparticles, the porous metallic plate being located above the glass plate.

6. The wet ESP as defined in claim 1 further comprising a baffle, wherein the baffle is mounted inside the housing and located between the chamber and the scrubbing-liquid collection reservoir.

* * * * *